United States Patent [19]

Holl

[11] 3,949,265

[45] Apr. 6, 1976

[54] MULTISTAGE CHARGED PARTICLE ACCELERATOR, WITH HIGH-VACUUM INSULATION

[75] Inventor: Peter Holl, Tubingen, Germany

[73] Assignee: Polymer-Physik GmbH, Germany

[22] Filed: Dec. 20, 1973

[21] Appl. No.: 426,571

[30] Foreign Application Priority Data

Jan. 22, 1973 Germany ..... 2302938

[52] U.S. Cl. ..... 315/15; 313/360; 313/361

[51] Int. Cl.[2] ..... H01J 29/46; H01J 29/58

[58] Field of Search ..... 315/15; 313/359, 360, 361

[56] References Cited

UNITED STATES PATENTS

| | | | |
|---|---|---|---|
| 2,206,558 | 7/1940 | Bennett | 313/359 |
| 2,988,671 | 6/1961 | Arnold | 313/359 X |
| 2,996,640 | 8/1961 | Eichenbaum | 315/15 |
| 3,223,871 | 12/1965 | Schlesinger | 315/15 |
| 3,330,901 | 7/1967 | Adrenne et al. | 313/361 X |
| 3,341,734 | 9/1967 | Nicholson | 315/15 |

*Primary Examiner*—Maynard R. Wilbur
*Assistant Examiner*—Gregory E. Montone
*Attorney, Agent, or Firm*—McGlew and Tuttle

[57] ABSTRACT

Multistage charged-particle accelerator for operating with accelerating voltages higher than 150 kV, consists essentially of a high-voltage insulator, a source for producing charged particles, a Wehnelt cylinder, an anode and a post-accelerating tube containing stack-wise positioned post-accelerating electrodes. A high vacuum is used for insulating the parts carrying the high voltages, at least one cylinder screen, surrounding these parts, being interposed between them and the vacuum vessel, which can itself also function as a cylindrical screen.

8 Claims, 1 Drawing Figure

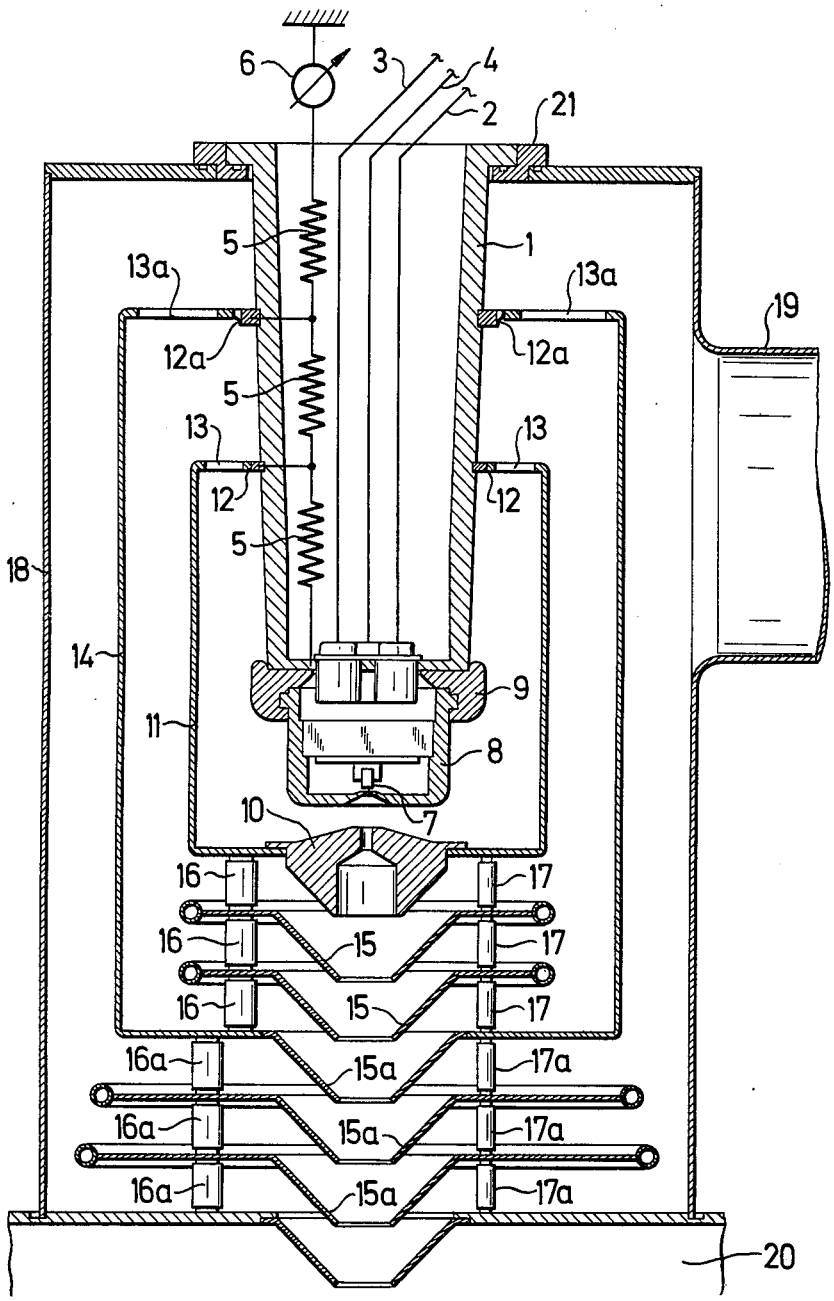
6
3
4
2
21
5
1
13a
13a
19
12a
12a
5
13
13
12
12
5
18
14
9
11
8
10
7
16
17
16
15
17
16
15
17
16a
15a
17a
16a
15a
17a
16a
15a
17a
20

MULTISTAGE CHARGED PARTICLE ACCELERATOR, WITH HIGH-VACUUM INSULATION

FIELD AND BACKGROUND OF THE INVENTION

In electron accelerators using acceleration voltages up to 150 kV it is known to use high vacuum for insulation. Accelerators of this kind have been used successfully for many years now in industry.

On the other hand, in electron accelerators constructed for acceleration voltages over 150 kV, the charged particle source (electrons or ions), and the post-acceleration stages, are still installed in a tank filled with an insulating gas at a pressure higher than atmospheric.

Charged-particle accelerators of this kind have the following disadvantages, in particular:

a. Whenever it becomes necessary to attend to the source of charged particles (replacement of the cathode in an electron accelerator, renewal of the gas or other material in an ion accelerator), the insulating gas has to be pumped out of the tank, stored, cleaned and finally pumped back into the tank, a time-consuming and costly operation. This applies particularly to the very costly $SF_6$, which is a good electron-negative gas but is very sensitive to moisture.

b. Due to presence of the pressure tank the accelerator has to be officially inspected at frequent intervals.

c. The pressure tank is of costly construction.

d. The post-accelerating tube contains a high vacuum and needs to be sealed carefully against the pressure tank. The seals used are usually rubber rings in contact with glass or ceramic. The individual sections of the apparatus must of course also be electrically insulated from each other. The constructional parts of the post-accelerating tube therefore have to perform two different functions. They have to act as gas seals and at the same time as voltage insulators.

e. The known accelerators are of complex and costly construction and are unsuitable in this regard for general use on a large scale in industry, where robustness and simple serviceing are essential.

SUMMARY OF THE INVENTION

The aim in the present invention is to provide a multistage charged-particle accelerator for acceleration voltages above 150 kV, which is free from the disadvantages mentioned above. In particular the intention is to construct the accelerator in such a way that cathode replacement or ion source replacement can be done in a simpler and more rapid manner.

The problem is solved by using high-vacuum insulation everywhere, rather than only in the post-accelerating tube, that is to say around the post-accelerating electrodes, where it is of course physically necessary to ensure that the charged particles have a sufficiently great mean free path. In the accelerator according to the invention all the parts carrying high voltages are insulated against earth by high vacuum. To contain the high voltages at least one cylindrical screen (screening electrode) is interposed between these parts and earth. It should be observed that in prior art accelerators the post accelerating tube is not subdivided step-wise between the parts carrying high voltages and the pressure tank. A step-wise subdivision in this sense is provided, according to the invention, by the interposed cylindrical screens.

In the accelerator according to the invention the post-accelerating tube, which forms the environment of the accelerated particles, is subdivided into several electrodes, as known per se, in the first place so as to prevent flashovers in this region of high ion density, and in the second place in order to focus the beam of charged particles better by utilising the lens effect produced by the electrodes of the post-accelerating tube.

The subject of the invention is therefore a multistage charged-particle accelerator for operating with accelerating voltages higher than 150 kV, consisting essentially of a high-voltage insulator, a source for producing charged particles, a Wehnelt cylinder, an anode and a post-accelerating tube containing stack-wise positioned post-accelerating electrodes, the accelerator according to the invention being characterised in that a high vacuum is used for insulating the parts carrying the high voltages, at least one cylindrical screen, surrounding these parts, being interposed between them and the vacuum vessel, which can itself also function as a cylindrical screen. The invention relates more particularly to accelerators with acceleration voltages between 300 and 450 kV. At the present time the highest acceleration voltage produced in the accelerator according to the invention is approximately 600 kV. The upper limit is set by the insulating strengths of the commercially available high voltage lead-in cables. In regard to the degree of vacuum, it has been found in practice that surprisingly good results are obtained using a vacuum of only $1 \times 10^{-4}$ Torr, a potential difference of 150 kV between neighboring screens, that is to say in the region outside the acceleration zone, and a potential difference of 50 kV between neighboring electrodes in the post-accelerating tube. However, the accelerator according to the invention is preferably operated with a vacuum between $1 \times 10^{-6}$ and $1 \times 10^{-7}$ Torr. For special purposes an ultra-high vacuum can of course be used.

BRIEF DESCRIPTION OF THE DRAWING

The invention will now be described in greater detail on the basis of the preferred example shown in the single FIGURE, which is a section through a particle accelerator according to the invention.

DESCRIPTION OF THE PREFERRED EMBODIMENT

A high-voltage insulator 1, which extends between earth potential and up to 450 kV, penetrates with its nose into the interior of a first cylindrical screen 11. With respect to this screen the insulator carries a potential of 150 kV. The insulator 1 contains in its interior a group of potential-divider resistors 5 for linearising the potential, a high-voltage lead-in 2, a lead 3 for heating the cathode and a further lead 4 for the Wehnelt voltage. Spring-loaded contact rings 12, **12*a* mounted outside the high-voltage insulator 1 make the necessary electric contact between the potential-divider resistors 5 and the cylindrical screens 11 and 14. The potential-divider current can be read off from an instrument 6 situated outside the insulator 1. The high-voltage insulator is equipped with a device 21 which allows it to be removed from the multistage charged-particle accelerator for exchanging cathodes, after venting the vacuum vessel 18. Mounted on the lower end of the high-voltage insulator 1 there is a beam-generating system consisting of a cathode 7, which can for example be a tungsten hairpin wire, and a Wehnelt cylinder 8. The cathode and the Wehnelt cylinder can form a unit connected by a bayonet catch to the insulator, to allow easy replacement without changing the adjustment of the system. The high-voltage insulator 1 is also equipped, at its lower end, with a corona ring 9, for stabilising the voltage. An anode 10 is mounted on the bottom of the first cylindrical screen 11, opposite the Wehnelt cylinder 8. The upper part of the first cylindrical screen 11 contains openings 13 to allow the cylindrical screen to be evacuated to high vacuum. The openings 13** are situated at locations which are uncritical in regard to high-voltage flashovers.

The first cylindrical screen 11 is surrounded by the second cylindrical screen 14, there being a further potential difference of 150 kV between the two screens. The high-voltage insulator 1 also penetrates downwards into the interior of the second cylindrical screen 14. Between the bottom of the first screen 11 and the bottom of the second screen 14 there is a stack of electrodes 15 forming a part of the post-accelerating tube. The potential difference between neighboring electrodes is at most 50 kV. The individual electrodes are supported on insulating feet 16, which together form the mechanical connection between the electrodes and the first cylindrical screen 11. Interposed between the electrodes 15 there are potential divider resistors 17, for establishing the desired potentials. It will be observed that these potential-divider resistors 17 are in parallel with the potential-divider resistors 5 situated within the high-voltage insulator 1. The second cylindrical screen 14 also has openings 13*a* to allow the screen to be evacuated.

The second cylindrical screen 14 is surrounded by the vacuum vessel 18, there being a further potential difference of 150 kV between these two parts. The high-voltage insulator is supported by the cover of the vacuum vessel 18. Between the bottom of the second cylindrical screen 14 and the bottom of the vacuum vessel 18 there are a further three electrodes 15*a* of the post-accelerating tube, supported on insulating feet 16*a*. Potential-divider resistors 17*a* are interposed between these electrodes 15*a*.

Vacuum is provided by a high-vacuum pump (not shown). The pump can be connected to the vacuum vessel 18 at any suitable location, for example at 19.

A scanner, or a target for the charged particles, can be attached to the bottom of the vacuum vessel 18 at the location 20.

Heat is removed from the cathode heater 3 and from the potential-divider resistors 5 by oil circulating in the interior of the high-voltage insulator 1.

The multistage charged-particle accelerator according to the invention is preferably constructed in the form of a cylindrical condenser, although other forms of construction are possible. The accelerator according to the invention is suitable for use, for example, in the following applications:

a. As an industrial electron accelerator (400 kV, 75 mA) for sanitizing sewage sludge at a throughput of 10 $m^3/h$.

At the beginning of each week shift the cathode 7 can be exchanged by simply lifting the high-voltage insulator 1 out of the vacuum vessel 18. After re-installing the insulator 1 the vessel 18 is put under vacuum by a preliminary vacuum pump. After 30 seconds pumping is automatically switched over to a high-vacuum pump. After a further 180 seconds the high voltage is switched on and irradiation begins. In the irradiation of sewage sludge, the cathode 7 is destroyed, by bombardment by residual gas ions, so that after less than 50 hours of operation the cathode has to be replaced. This can be done, as already mentioned, at the beginning of the next shift.

b. As an industrial electron-beam source for use in the hardening of lacquers in the woodworking industries (acceleration potential 300 kV, maximal electron current 50 mA, scanning width 2.40 m).

For acceleration voltages up to 300 kV adequate highvoltage insulation is provided by two cylindrical screens nested the one within the other, the outer screen taking the form of the vacuum vessel 18 itself. In this case the electrons are post-accelerated in three stages by electrodes 15 situated between the first cylindrical screen 11 and the vacuum vessel 18. The cathode can be replaced very rapidly, as described above. This accelerator hardened lacquer at the rate of 450 kg/h, with 50 percent energy conversion.

c. When the accelerator is used for projecting a beam of ions, the electron source is replaced by an ion source. Arranged in this way the appartus is capable of accelerating ions up to an energy of 400 kV. On leaving the post-accelerating tube the ions pass through a diffusion gap out into the external air. The beam of accelerated ions can for example be used for stimulating reactions in chemical substances.

While a specific embodiment of the invention has been shown and described in detail to illustrate the principles of the application, it will be understood that the invention may be embodied otherwise without departing from such principles.

I claim:

1. A multistage charged-particle accelerator for operating with accelerating voltages higher than 150 kV comprising, in combination, a vacuum vessel; a relatively elongated high voltage insulator disengageably mounted on said vacuum vessel to extend thereinto; a Wehnelt cylinder and a source for producing charged particles mounted on the inner end of said high voltage insulator; an anode; means in said vacuum vessel supporting said anode in spaced relation to said source; said Wehnelt cylinder and said source constituting parts carrying the high voltages; a post-accelerating tube, containing stack-wise positioned post-accelerating electrodes, extending from said anode in said vacuum vessel; means, including a high voltage cable, supplying the operating potentials for said parts carrying the high voltage, said anode and said electrodes; said vacuum vessel having means for connection to a source of high vacuum for providing a high vacuum in said vessel to constitute the insulating medium for the parts carrying the high voltage; and at least one cylindrical screen in said vessel surrounding the parts carrying the high voltage and interposed between these parts and the vacuum vessel; said vacuum vessel functioning as a cylindrical screen.

2. Accelerator according to claim 1, including at least two said cylindrical screens nested within one another and surrounding the parts carrying the high voltages; said cylindrical screens being so arranged that, at the locations where no charged particles are accelerated, the potential difference between adjacent screens is at least 150 kV; and, at locations where charged particles are accelerated, the potential difference between adjacent post-accelerating electrodes is a maximum of 50kV.

3. Accelerator according to claim 2, in which said means supplying said operating potentials includes first potential-divider resistors connected between said vacuum vessel and said screens, and second potentialdivider resistors connected between said post-accelerating electrodes in parallel with said first potential-divider.

4. Accelerator according to claim 2 in which a high vacuum of at least $1 \times 10^{-4}$ Torr is used for insulating the parts carrying the high voltages.

5. Accelerator according to claim 2 in which the accelerator is constructed for acceleration voltages between 300 and 450 kV.

6. Accelerator according to claim 2 in which the accelerator is equipped with an electron source, the accelerated charged particles being electrons.

7. Accelerator according to claim 2 in which the accelerator is equipped with an ion source, the accelerated particles being ions.

8. Accelerator according to claim 2 constituting an electron accelerator for sanitizing sewage sludge.

* * * * *